US005631802A

United States Patent [19]

Trusty

[11] Patent Number: 5,631,802

[45] Date of Patent: May 20, 1997

[54] CONTROL RING FOR INPUT SPRAY IN ELECTROSTATIC SPRAY SYSTEM

[75] Inventor: Dennis L. Trusty, Bismarck, N. Dak.

[73] Assignee: Clark Equipment Company, Woodcliff Lake, N.J.

[21] Appl. No.: 372,564

[22] Filed: Jan. 13, 1995

[51] Int. Cl.[6] ..... B05B 5/025

[52] U.S. Cl. ..... 361/228

[58] Field of Search ..... 361/225, 226, 361/227, 228; 239/3, 690

[56] References Cited

U.S. PATENT DOCUMENTS

| | | | |
|---|---|---|---|
| 1,661,226 | 4/1928 | Mintz et al. | 361/228 |
| 2,525,347 | 10/1950 | Gilman | 361/227 |
| 2,673,232 | 3/1954 | Silsby, Jr. . | |
| 3,098,890 | 7/1963 | Peterson . | |
| 3,360,035 | 12/1967 | Van Loo et al. . | |
| 3,761,941 | 9/1973 | Robertson . | |
| 3,905,550 | 9/1975 | Rokadia et al. . | |
| 3,934,055 | 1/1976 | Tamny . | |
| 4,077,227 | 3/1978 | Larson . | |
| 4,560,107 | 12/1985 | Inculet . | |
| 4,618,432 | 10/1986 | Mintz et al. | 361/226 |
| 4,629,119 | 12/1986 | Plunkett et al. . | |
| 4,630,169 | 12/1986 | Kelly | 361/225 |
| 4,788,617 | 11/1988 | Davidson | 361/1 |

*Primary Examiner*—Fritz Fleming

*Attorney, Agent, or Firm*—Westman, Champlin & Kelly, P.A.

[57] ABSTRACT

A guard ring for controlling size of a sprinkler column of liquid streams from a sprinkler head in an electrostatic spraying system is connected through a large resistor to ground. This provides an interaction between the liquid sprinkler column and the ring which tends to constrict the size of the column of sprinkled liquid and reduce the likelihood of the column spreading out and engaging sides of a receptacle used for receiving the liquid. The ring does not require power.

9 Claims, 2 Drawing Sheets

VOLTAGE SOURCE
LIQUID
84
86
22
21
62
64
54
75
56
28
61
60
36
65
58
57
52
48
26
38
50
80
88B
88C
40
78
79
32
88
34
39
M
44
42
88A 60
58
57
64
62

LIQUID SOURCE
V
75
56
54
61
61
62
60
58
57
64
52
50
72
67
46
72A
73
76
78
39
45
44
86
79
40
M
42

CONTROL RING FOR INPUT SPRAY IN ELECTROSTATIC SPRAY SYSTEM

CROSS REFERENCE TO RELATED APPLICATION

Reference is made to copending application Ser. No. 08/372,377, filed Jan. 13, 1995 and entitled FRAME MOUNTED ISOLATED MOTOR DRIVEN ELECTROSTATIC SPRAY SYSTEM, and assigned to the same assignee as this application.

BACKGROUND OF THE INVENTION

The present invention relates to a system for aiding in controlling current loss through a liquid column from a sprinkler head providing liquid to an electrostatic spraying system.

Various electrostatic spray systems have been advanced for spraying materials. U.S. Pat. No. 4,788,617 discloses an electrostatic spray system which utilizes two containers with liquid transfer between the containers. A sprinkler head adds makeup liquid to one tank. An electrostatic charge of high voltage is applied to a liquid in a second container and the liquid is then sprayed onto plants, for example. This device requires two closed pressurized tanks and requires control over the current flow between the tanks for operation. An induction ring is used around the sprinkler head output and is provided with a voltage of opposite polarity from the voltage providing the electrostatic charge. The induction ring voltage is controlled to reduce current flow back through the sprinkler head to ground.

An induction ring used around a sprinkler output in an electrostatic spray system is shown in U.S. Pat. No. 3,905,550. This induction ring is grounded directly.

It has been discovered that using an open-top container, and controlling the spacing between a head sprinkling liquid into the container and then providing an electrostatic charge to the liquid as it is pumped from the container provides a simplified construction if the container, the pump and other parts are isolated from ground through suitable insulators. In this arrangement, control of the size of the output from a makeup liquid sprinkler head can be controlled by a unique control ring.

SUMMARY OF THE INVENTION

The present invention relates to an electrostatic spray system which uses an open-top liquid container that is connected to a pump through which a high voltage is applied to the liquid as the liquid is pumped to spray nozzles. The open-top container and pump are mounted on a support or frame that is electrically isolated from electrical ground. As shown the container and pump are mounted on an isolated platform supported from a vehicle which may carry the spray system for spraying. Liquid is provided to the open top container, then a sprinkler head provides a gentle spray or sprinkle of liquid into the container.

Current leakage from the electrostatically charged liquid back to liquid coming from a sprinkler head is controlled by maintaining an appropriate spacing between the sprinkler head and the container, as well as by controlling the size of the liquid stream from the sprinkler, called a sprinkler or spray column.

A metal ring that is connected through a large resistor to ground surrounds the sprinkler column and provides a guard field for controlling the sprinkler column size to prevent the liquid stream being sprinkled as a liquid column from spreading and migrating to the sidewalls of the container, which tends to increase current leakage to ground through the liquid being sprinkled.

DETAILED DESCRIPTION OF THE PREFERRED EMBODIMENTS

Figure 1:
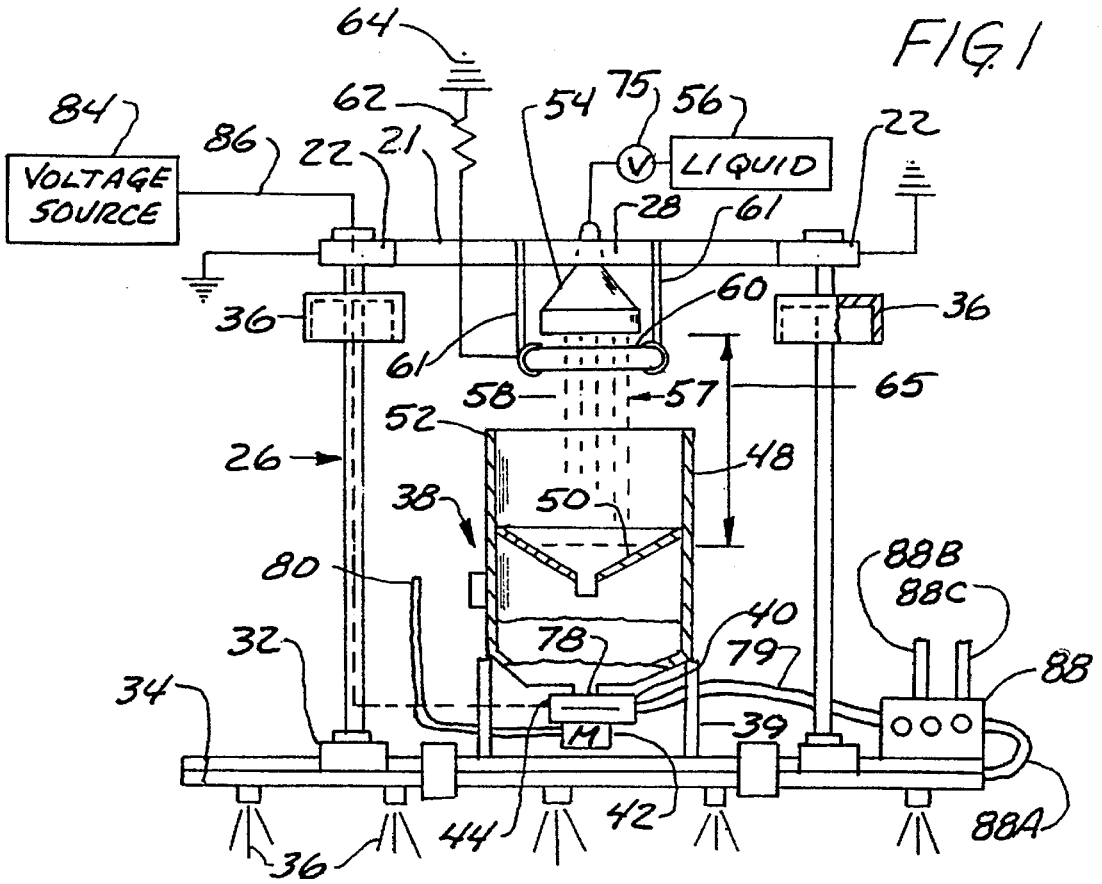
FIG. 1 is a schematic elevational view of a typical electrostatic spray system made according to the present invention with parts broken away.
Figure 3:
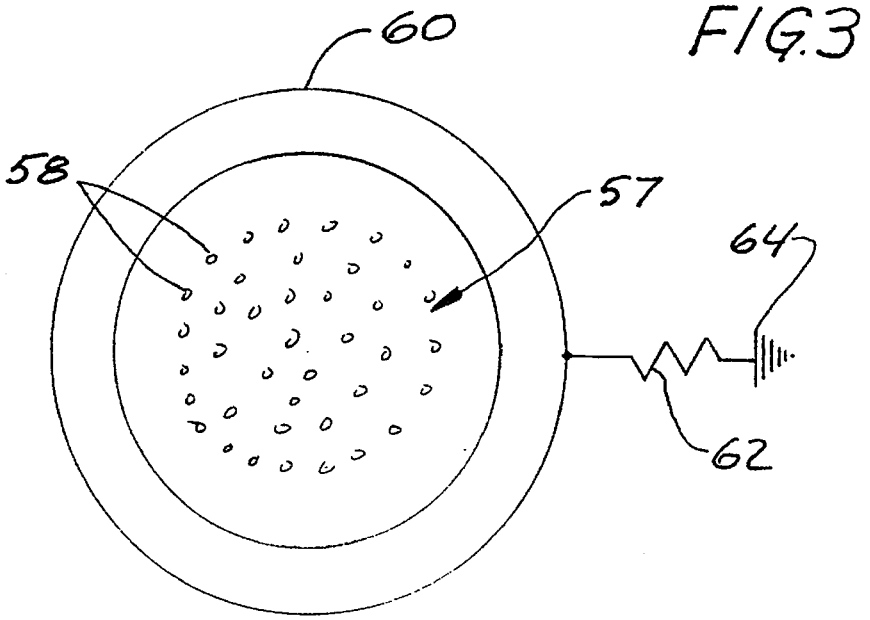
FIG. 3 is a plan view of a guard ring made according to the present invention.
Figure 2:
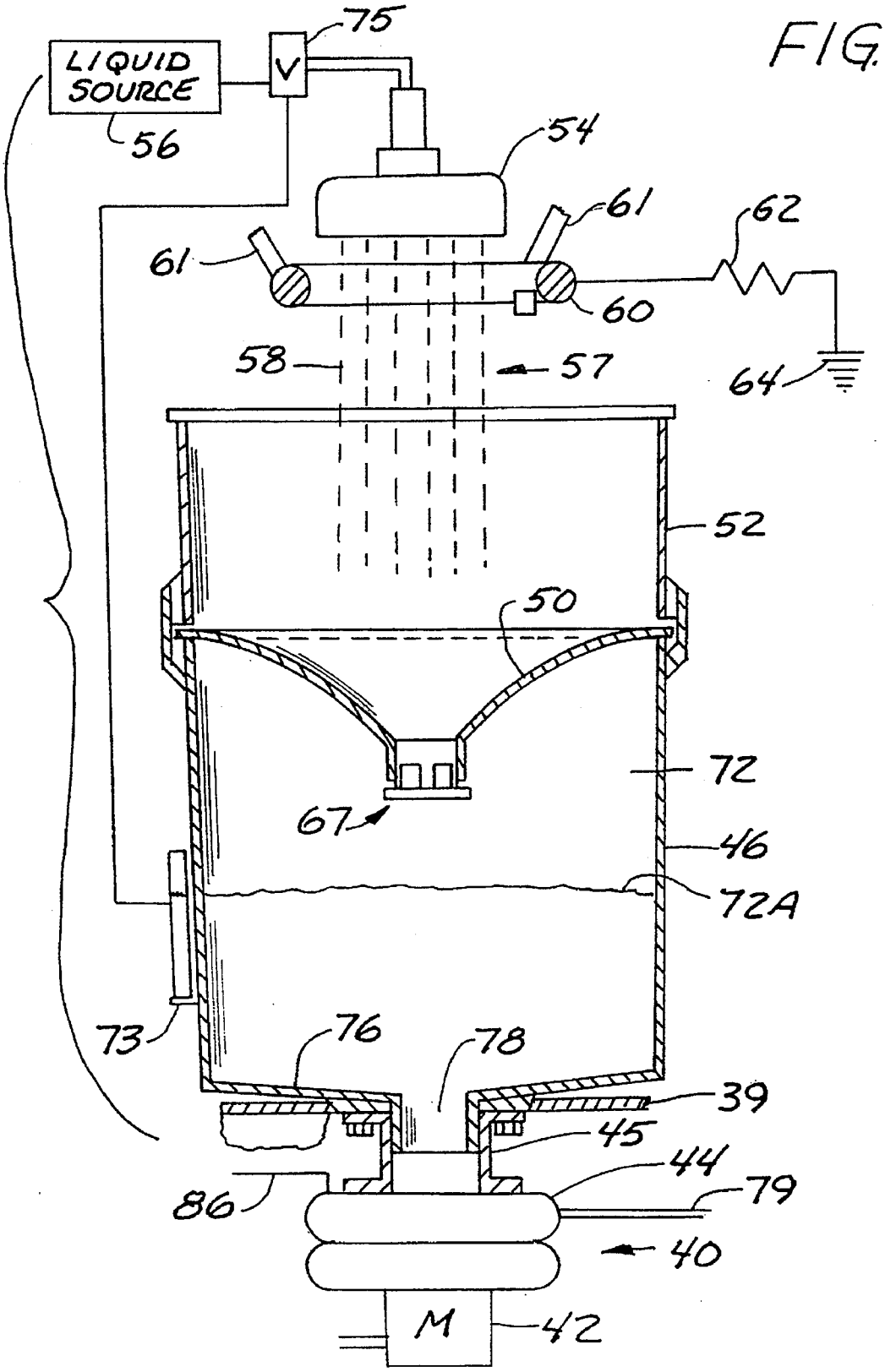
FIG. 2 is an enlarged sectional view of an open-top container and guard ring used with the spray system of the present invention.

One of the problems that has consistently occurred in electrostatic spray systems is current leakage to ground. In the present invention, a spray system is adapted for use in a wide variety of applications, including industrial applications such as spraying films on textiles, and other spraying operations. Additionally, coating agricultural crop seed with various films such as fertilizer, seed starter compounds and fumigants can be done with this type of electrostatic sprayer. A further application is the use in connection with large field sprayers. To reduce current leakage, it is desirable to reduce liquid coatings or films from forming on sidewalls of liquid containers or reservoirs used. Reducing migration of liquid to the sidewalls is desirable and the present invention aids in controlling liquid transfer in a simplified manner. An electric spray system indicated at 26 may be mounted onto a suitable support frame in a desired location. As shown, a pair of grounded arms 22 that are supported back to a grounded frame 21 are used to support the spray system 26. A pair of suitable tubular insulating rods or isolator links 30 are attached to the arms 22. The insulating rods 30 can be made of tubular fiberglass or other suitable materials that are good insulators and they are used to support a frame or support 32. The frame 32 can take any desired configuration. As shown, the frame 32 supports a tubular spray bar section 34 on which spray nozzles 36 are mounted.

To minimize migration of moisture back to the grounded arms 22, a pair or inverted insulating cups 37, 37 are supported on the pair of tubular rods 30, and sealed tightly on the outer surfaces of the tubes or rods 30, so that if moisture migrates along the rods, the moisture will be stopped by the insulating cup and will not cause a short or current conducting path back to the arms 22.

The frame 32 is used for supporting an open-top spray liquid container or reservoir tank shown generally at 38. The spray liquid container 38 is suitably supported on a frame 39 on frame 32 above a pump and motor assembly indicated at 40 which includes a drive motor 42 and a pump 44. The liquid container 38 also is known as a charge tank and or reservoir and stores a supply of conductive liquid that is to be electrically charged.

The container 38 is made with a lower portion 46, and an upper portion 48, which is made in two sections. The upper portion 48 has a lower tapered funnel bottom section 50 and an upper cylindrical section 52. A splash guard 67 is used at the outlet of the funnel 50.

A sprinkler or shower head 54 is mounted suitably onto an arm 28, also supported on frame 21, and provides a spray or sprinkler column of conductive liquid stream from a pressurized source, such as a pump, indicated at 56, through a valve 75. A shower or sprinkler column 57 of liquid streams of conductive liquid, as disclosed, water is formed. The water is in the form of broken streams indicated at 58 to sprinkle into the open top of the spray liquid container 38.

The streams or sprinkles of water 58 pass through a conductive material guard ring 60, which, as shown, is electrically connected through a large resistor 62 to a low potential terminal, for example, electrical ground 64. The use of the large resistor limits current flow back to ground, but permits a potential or voltage drop to maintain a low voltage field around the sprinkler column. The low voltage field has the effect of tending to repel the liquid streams and constrict the diameter or size of the overall spray or sprinkler column 57. This also reduces the attraction between the conductive liquid stream and the outer side edges of the container upper cylindrical section 52. It keeps the sprinkler column from splashing over the container walls as well.

The conductive ring 60 is supported from the arm 28 that also supports the sprinkler head 54 with insulator material supports 61. The supports 61 electrically isolate the ring 60 from the arm 28.

The distance from the sprinkler head 54 to the contact line on the funnel portion 50 where the liquid column contacts the funnel portion, generally represented as a double arrow 65 is maintained sufficiently large so that the current leakage back to the sprinkler head, which is connected to ground, is not significant. Constricting the size of the sprinkler column by use of a non-powered guard ring insures that the upper part of the wall of the container is not continuously kept wet or damp. The individual streams of liquid (usually water) in the sprinkler column 58 are controlled so that they are intermittent and do not form a direct conduit for current leakage back to the sprinkler head 54 and the liquid supply.

The level of liquid shown at 72A can be maintained using a level sensor 73 operating a valve 75 to control flow of liquid to the sprinkler head, and control the level. The valve can be adjusted to provide suitable volume of liquid so the streams are intermittent.

An outlet 78 from the spray liquid container 38 and in particular the lower section 46 is in the center of the bottom wall 76. The bottom wall 76 can be slightly curved down to the outlet 78. The pump 44 has an inlet connected to the outlet 78.

The pump 44 is driven by a hydraulic motor 42 to provide pressure in an outlet line 79. The motor 42 receives its power through hydraulic lines 80. The hydraulic lines are non-conductive, usually some synthetic elastomeric material reinforced with synthetic fibers, so the lines are electrical insulators. The hydraulic fluid, which is an oil, is also non-conductive so that there is no electrical path from the power source used for driving the pump back to ground.

A high voltage source (for example, 20,000 to 60,000 volts) indicated generally at 84 is connected through a highly insulated line 86 to a metal or conductive housing of pump 44 or to another electrode in the container 38 or in lines connected to the pump to electrically charge the liquid passing through the outlet 78 and into the pump 44. The insulated line 86, as shown, passes through the center of one of the tubular insulating rods 30, and then out through a small opening in the rod. The opening can be filled with a non-conductive putty or gasket material to seal the interior passageway of the rod 30 from moisture. The line 86 can be connected to an electrode in pipe 45, to the lower portion of container 38, in outlet line 79 or other locations where the conductive liquid is present in a constant stream, if desired.

Outlet line 79 carries charged liquid under pressure and connects to a manifold 88. The manifold in turn has valves that can be manually opened or remotely controlled to connect lines such as 88A to the spray bar 34, and thus to the nozzles 36, or valves can be selectively opened to other lines 88B and 88C which connect to other outlets.

It has been found that maintaining the distance from the shower head 54 to the contact lines of the sprinkler column on the container walls, namely funnel portion 50 or, if the spray column spreads out where the liquid contacts the sidewall of the upper portion 45 of liquid container 38 at a sufficient distance prevents any substantial current leakage back to ground through the air gap to the sprinkler head or spray column 58. If the diameter of the liquid container 38 used is large enough, the sprinkler head 54 can actually be inside the container, but as shown the sprinkler head is spaced above the open top of container 38 to conserve mounting space and yet operate satisfactorily.

Controlling the pressure or flow at the shower head also can be helpful in reducing the current leakage back to ground. The higher the pressure, the less the water tends to go to the container sidewalls, but the more current tends to feed back to the water supply, because the liquid streams become more constant rather than intermittent. There is a balance between the pressure of the supply from the liquid to the shower head to avoid conduction back to ground, either by way of the streams of water or by having the distance between the container walls and the shower head reduced. The high voltage line 86, and the high voltage connection to the pump, as well as the voltage applying electrode, which is the pump housing, are all on the exterior of the water supply tank.

Mounting of the frame 32 onto insulator supports and mounting all of the high voltage components on the electrically isolated frame 32 minimizes current leakage and loss, which is one of the problems with electrostatic material handling. The liquid container is not pressured in the present invention, which eliminates the need for having an air pressure source connected to the wet container. The arrangement shown, including the unique guard ring 60 keeps current leakage back to the shower head very low, generally 10 to 20 microamps.

The resistor 62 is selected to be large to prevent substantial current passage back to ground. At least 1 megohm of resistance is used and larger resistance values will work. The guard ring 60 is made of an electrically conductive material and selected in size to be spaced from the column 57 of sprinkler stream 58 to prevent direct wetting of the ring. The ring should be of size to surround the major portion of the liquid sprinkler column and preferably is an annular ring or a peripheral encircling ring. The ring is a passive guard that disrupts the effect of the electrical field inside the container which tends to draw the conductive liquid toward the wall of the container. The guarding causes the liquid column to reduce or collapse in cross section, and not spread out as it approaches the tank. The internal diameter of the ring is preferred to be 1.15 to 1.75 times the diameter of the liquid sprinkler column. The position of the guard ring relative to the face of the sprinkler head also has an effect on the performance of the ring.

If the sprinkler head and liquid column are square or rectangular, the ring would be the same configuration as the column and have a transverse dimension 1.15 to 1.75 times a straight transverse line across the sprinkler head liquid column and intersecting the guard ring.

Although the present invention has been described with reference to preferred embodiments, workers skilled in the art will recognize that changes may be made in form and detail without departing from the spirit and scope of the invention.

What is claimed is:

1. An electrostatic spray system device, including a sprinkler head at substantially ground electrical potential transferring a conductive liquid to a container where an electrostatic charge is applied to such liquid, said sprinkler head being above the container and providing a plurality of streams of conductive liquid forming a sprinkler liquid column between the sprinkler head and liquid in the container, a conductive ring of larger size than the sprinkler liquid column surrounding at least a major portion of a periphery of the sprinkler liquid column adjacent to the sprinkler head and spaced above the container, and a resistor connected to the conductive ring at one end thereof and directly to substantially ground potential at the other end thereof to form substantially a ground potential at the ring for limiting current through the ring to ground potential.

2. The device of claim 1 in which the container is an open-top container, and the liquid in the container has an electrostatic charge thereon at a high voltage.

3. The device of claim 2, wherein the electrostatic charge is in the range of 20,000 to 60,000 volts.

4. The device of claim 1, wherein the ring has an internal size spaced from the liquid column a selected distance.

5. The device of claim 1, wherein the resistor is at least 1 megohm in size.

6. The device of claim 1, wherein the ring is a peripheral ring and has an internal lateral dimension between 1.15 and 1.75 the lateral dimension of the liquid sprinkler column along the straight line extending across the lateral dimension of the liquid sprinkler column and intersecting the ring.

7. The device of claim 1, wherein the liquid sprinkler column is generally circular in cross section and the ring is also circular and has an internal diameter between 1.15 and 1.75 times the diameter of the liquid sprinkler column.

8. An electrostatic spray system including a sprinkler head for transferring a column of conductive liquid to an open-topped container, said sprinkler head being spaced above the open-topped container and providing said column from above the open-topped container, said column being of smaller transverse dimension than the open top of the container, the container being at a substantially higher electrical potential than the liquid column, an electrically conductive ring of larger size than the liquid column positioned between the sprinkler head and the open top of the container and surrounding at least a major portion of the liquid column adjacent to the sprinkler head, and a resistor connected between the conductive ring and substantially a ground potential to form a conductive path to the ground potential for limiting current conduction from the conductive ring to the ground potential, the ring being free connection to electrical power sources.

9. An electrostatic spray system including a frame, a sprinkler head mounted on the frame, the frame being at a ground electrical potential, an open topped container mounted on the frame, below and spaced from the sprinkler head, a source of conductive liquid that is to be electrostatically charged connected to the sprinkler head, said sprinkler head providing a plurality of streams of conductive liquid at substantial ground potential from the source as a sprinkler liquid column flowing between the sprinkler head and a level of the liquid in the container, a conductive ring supported on insulating supports from the frame, said conductive ring being of larger size than the sprinkler liquid column and surrounding at least a major portion of the sprinkler liquid column below and adjacent to the sprinkler head and above the container, and a resistor having one end connected to the conductive ring and having a second end connected to substantially ground electrical potential to form a non-powered electrical path for establishing a low potential substantially surrounding the conductive liquid column a the resistor being selected to limit current draw between the conductive ring and substantially ground potential.

* * * * *

UNITED STATES PATENT AND TRADEMARK OFFICE

CERTIFICATE OF CORRECTION

PATENT NO. : 5,631,802

DATED : May 20, 1997

INVENTOR(S) : Trusty

It is certified that error appears in the above-indentified patent and that said Letters Patent is hereby corrected as shown below:

Column 6, line 34, after "column" insert --,--,

Column 6, line 35, delete "a".

Signed and Sealed this

Second Day of December, 1997

*Attest:*

*Attesting Officer*

BRUCE LEHMAN

*Commissioner of Patents and Trademarks*